US006832751B2

(12) United States Patent
Shannon

(10) Patent No.: US 6,832,751 B2
(45) Date of Patent: Dec. 21, 2004

(54) CARPET PATTERN ADJUSTING DEVICE AND METHOD OF USE

(76) Inventor: Steve Shannon, 359 Linden Ct., Herndon, VA (US) 20170

( * ) Notice: Subject to any disclaimer, the term of this patent is extended or adjusted under 35 U.S.C. 154(b) by 29 days.

(21) Appl. No.: 10/266,613

(22) Filed: Oct. 9, 2002

(65) Prior Publication Data

US 2004/0069980 A1 Apr. 15, 2004

(51) Int. Cl.[7] ..... B66D 1/00
(52) U.S. Cl. ..... 254/202; 254/209; 294/806
(58) Field of Search ..... 254/200, 202, 254/203, 205, 206, 209, 210, 212; 294/8.6

(56) References Cited

U.S. PATENT DOCUMENTS

| | | | | | |
|---|---|---|---|---|---|
| 555,362 | A | | 2/1896 | Chamberlain | |
| 1,072,599 | A | | 9/1913 | Gibbons | |
| 1,989,020 | A | | 1/1935 | Paternayan | |
| 2,482,186 | A | | 9/1949 | Huff | |
| 3,498,661 | A | * | 3/1970 | Graziano | 294/8.6 |
| 4,332,371 | A | | 6/1982 | Bell et al. | |
| 4,560,146 | A | * | 12/1985 | Thomas et al. | 254/202 |
| 5,348,608 | A | | 9/1994 | Glenn | |
| 5,472,170 | A | * | 12/1995 | Anasson | 254/212 |
| 5,855,361 | A | * | 1/1999 | Krowchak | 254/209 |
| 5,938,182 | A | * | 8/1999 | Goodrich et al. | 254/209 |
| 6,491,284 | B1 | * | 12/2002 | Jolly et al. | 254/209 |

* cited by examiner

*Primary Examiner*—Emmanuel M Marcelo
(74) *Attorney, Agent, or Firm*—Merek, Blackmon & Voorhees, LLC

(57) ABSTRACT

A carpet installation device having multiple adjustment features to facilitate carpet installation. These features include a base member of variable length having carpet gripping spikes mounted on the bottom thereof. A winch support mounted on said base member for receiving a winch. The winch includes a winch cable for connecting the winch to a remote anchor. The winch being able to stretch the carpet by pulling said base member toward said anchor. An additional carpet adjusting tool is moveably mounted on the base member for adjusting carpet sections. The carpet adjusting tool includes carpet gripping spikes thereon and linkage operated movement for stretching small sections of carpet between the spikes on the base member and those on the carpet adjusting tool.

14 Claims, 7 Drawing Sheets

CARPET PATTERN ADJUSTING DEVICE AND METHOD OF USE

FIELD OF THE INVENTION

This invention relates to devices for installation of carpeting and methods of carpet installation. In particular, the invention relates to a device for installing rolls of carpet and adjusting carpet that has a bow from manufacture and needs to be installed to perfect alignment with adjacent rolls.

BACKGROUND OF THE INVENTION

All textile products, such as carpet, due to their nature and flexibility have inherent distortion. Distortions occur in the process of manufacturing carpet. Therefore, when the construction of the product includes a pattern, additional installation steps are required to match the pattern of adjacent carpet pieces. These additional steps can include dry laying carpet to initially check the distortion of the pattern, row cutting on pattern, positioning carpet with a knee kick, use of dry lines to check and create a reference point for pattern straightness and power stretching carpet into alignment and possibly stay nailing carpet to hold it in place while the adhesive sets.

Several common defects occur which must be corrected in the laying of carpet. These common defects include bow, skew and trueness of edge. Bowing occurs when the pattern has gained or lagged in the middle of the roll width. A skew occurs when the pattern tends to form an angle to the length of the roll. Trueness of edge is evident when the edge forms the shape of an 'S'. In all three instances, these pattern distortions cannot be cut out. Instead they must be stretched square again to assure proper pattern match.

Prior devices for correcting these defects used some variety of mechanical advantage to adjust the carpet to correct the defects. A number of carpet stretchers have heretofore been proposed. Early carpet stretchers were secured adjacent a wall and the carpet was pulled by the stretcher toward the wall. Later, it was recognized that pulling carpet was not as easily accomplished as pushing the carpet. Thus, later carpet stretchers had a foot abutting against one wall and stretched the carpet from that wall outwardly toward an opposite wall. Problems occurred in utilizing these stretchers where the rooms were extremely large as the stretching force buckled the stretchers at median points between where the force was applied to the wall and the stretcher was engaged to the carpet. Furthermore, interior walls in modern buildings are commonly not strong enough to withstand the force necessary to stretch large sections of carpet.

More recently, frames have been proposed which extend between opposite walls of long rooms in which the carpet is stretched between members of the frame. The frame prevents the carpet stretcher from buckling as experienced in the past, however, extremely long stretching mechanisms were still required. Artificial supports were provided such that stretchers could be anchored at positions between opposite walls and the carpet stretched in opposite directions toward each wall. These multipart systems are cumbersome to use and require extra expense of shipping and setup.

Hence, there exists a significant need for a carpet installation device and method of use overcomes the substantial and numerous inherent disadvantages of the prior art.

OBJECTS AND SUMMARY OF THE INVENTION

It is an object of the invention to provide a carpet installation device for enabling a carpet installer to easily adjust carpet during the carpet installation process.

Another object of the invention is to provide a carpet installation device having adjustment features to vary the size of the device according to the width of the carpet being installed.

Yet another object of the invention is to provide a carpet installation device having slidable adjustment features to facilitate carpet adjustment along the entire width of a roll of carpet.

Still another object of the invention is to provide a mounting for supporting a winch and an anchor for connecting a winch cable thereto for stretching the carpet.

Yet another object of the invention is to provide a channel for supporting a winch cable over a roll of carpet to prevent damage to the carpet roll.

These and other objects of the present invention will be readily apparent upon review of the following detailed description of the invention and the accompanying drawings. These objects of the present invention are not exhaustive and are not to be construed as limiting the scope of the claimed invention.

In summary, the invention is directed to a carpet installation device having multiple adjustment features to facilitate carpet installation. These features include a base member of variable length having carpet gripping spikes mounted on the bottom thereof. A winch support mounted on said base member for receiving a winch. The winch includes a winch cable for connecting the winch to a remote anchor. The winch being able to stretch the carpet by pulling said base member toward said anchor. An additional carpet adjusting tool is moveably mounted on the base member for adjusting carpet sections. The carpet adjusting tool includes carpet gripping spikes thereon and linkage operated movement for stretching small sections of carpet between the spikes on the base member and those on the carpet adjusting tool.

With these and other considerations in mind, as will become apparent hereinafter, the invention includes certain novel features of construction, combination and arrangement of parts and portions as will be set forth in the appended claims, reference being had to the accompanying drawings and detailed description thereof.

DETAILED DESCRIPTION OF THE PREFERED EMBODIMENT

Figure 1:
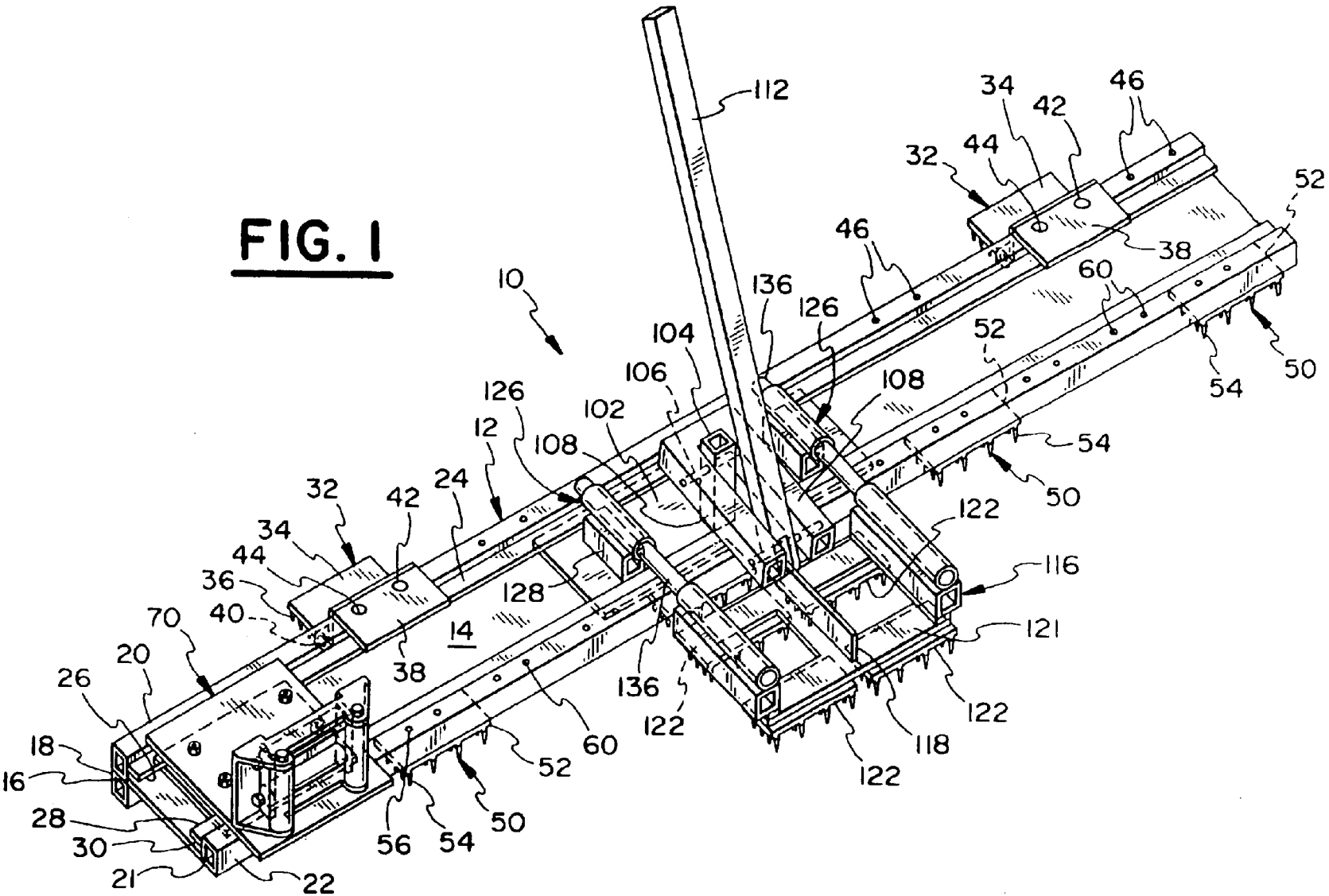
FIG. 1 is a perspective view of the base member of the carpet installation device.

FIG. 1 shows the carpet installation device 10 having a base member 12. Base member 12 is preferably formed of suitable strong material such as steel or aluminum although it should be understood that other materials such as other metals or plastics could be used for some or all parts of the base member 12 or other parts of the installation device 10. As can be seen in FIG. 1, the base member 12 includes a base plate section 14 formed in an elongated sheet of a thickness preferably about $\frac{1}{8}^{th}$ inches, a width of about six inches and a length of preferably two feet. Multiple base plate sections 14 may be joined together to lengthen the base member 12 according to the width of a carpet roll being installed. Each base plate section 14 has a rear edge 16 joined to a pair box tubes 18 and 20 and a front edge 21 connected to box tube 22. A rear edge strip 24 of about $\frac{1}{8}^{th}$ inch in thickness and one inch in width and running the length of each base plate section 14 and joined to box tube 20. The rear edge strip 24 is spaced above the base plate section 14 about 3/16ths of an inch and forms a groove 26. A front edge strip 28 of about $\frac{1}{8}^{th}$ inch in thickness and one inch in width and running the length of base plate section 14 and joined to box tube 22. The front edge strip 28 is spaced above base plate section 14 about 3/16ths of an inch and forms a 3/16ths inch by one inch groove 30. Box tube 20 further includes carpet gripping attachments 32 joined thereto. The gripping attachments are formed of plates 34 having suitable carpet gripping means such as angled spikes 36 extending downwardly therefrom to grip the carpet during adjustment. The size of the plates 34 and length and number of spikes may vary according to thickness and weave of carpet, but preferably, the plates are about 2 inches wide by three inches in length and the spikes number about 16 and are about a half inch in length and are angled rearwardly. Plates 34 are preferably pivotal to permit the spikes 36 to be disengaged from the carpet without lifting the entire base member 12 which permits sliding of the base member 12 to allow repositioning. Each of the gripping attachments 32 includes an L-shaped bracket 38 connected to the plate 34 via a hinge 40 to permit pivoting. L-shaped bracket 38 is preferably joined to box tube 20 by set screws 42 through holes 44 in the L-shaped bracket and corresponding holes 46 in box tube 20 to allow removeability and repositioning along the length of box tube 20 of gripping attachments 32. It may be desirable to have more or less gripping attachments 32 depending on the weave and thickness of the carpet. Box tube 22 also has gripping attachments 50 connected on the bottom 52 thereof. Again, gripping attachments 50 having a plate 52 and spikes 54 are joined to box tube 22 by removeable set screws 56 extending through holes 58 in plate 52 and holes 60 in box tube 22. Spikes 54 are angled forwardly of base member 12 to engage the carpet as the base member is pulled forward.

Figure 2:
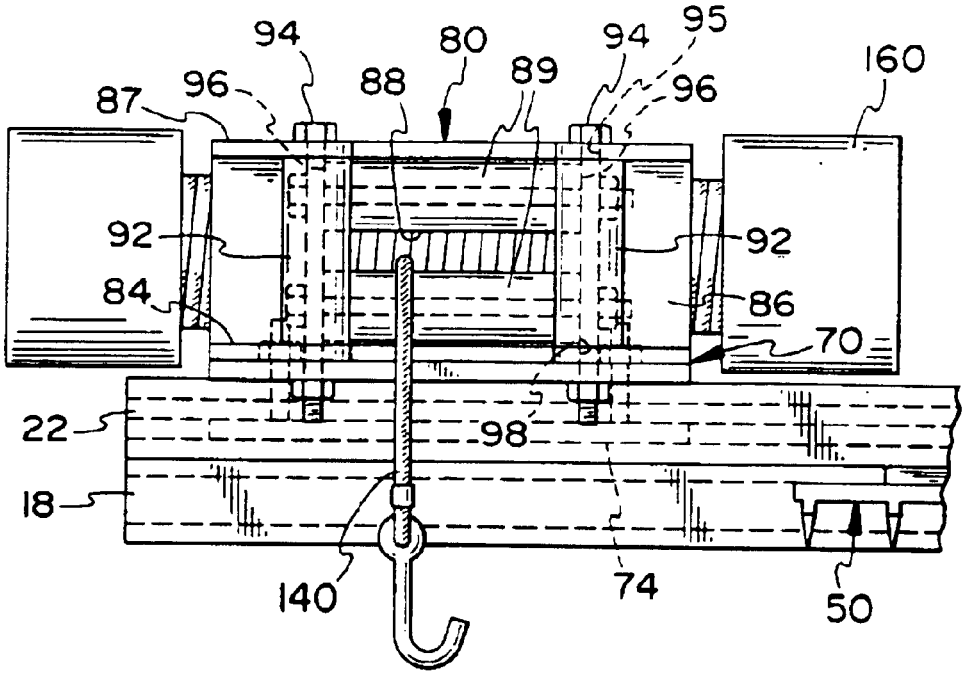
FIG. 2 is rear view of the winch mount with portions of the base member broken away.
Figure 3:
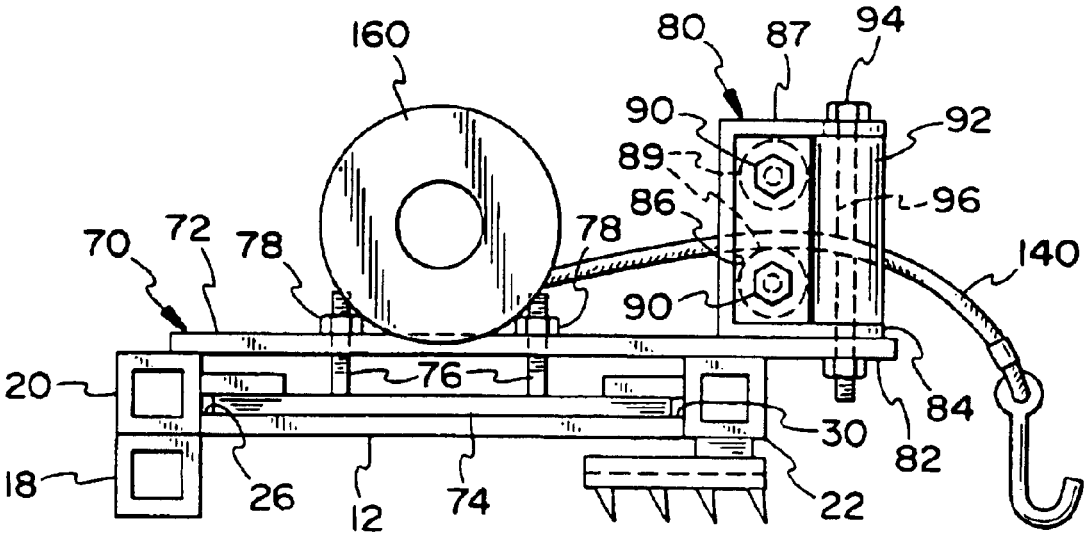
FIG. 3 is a side view of the winch mount attached to the base member.

In order to stretch large lengths of carpet, it is necessary to use a great deal of force. To that end, the present invention contemplates the use of a winch, either manual or more preferably powered. Now, the winch mounting bracket 70 will be described with reference to FIGS. 1, 2 and 3. Winch mounting bracket 70 includes an upper plate 72 and lower plate 74. Lower plate 74 is sized to slide into grooves 26 and 30 of base member 12. Bolts 76 extend upwardly from lower plate 74 through upper plate 72 and are tightened thereto by nuts 78. By tightening nuts 78 sufficiently, upper plate 72 and lower plate 74 can be rigidly fixed to base member 12 to prevent accidental movement. However, by loosening nuts 78, the entire mounting bracket 70 can be slid along base member 12 as necessary to allow stretching force to be applied anywhere along the entire width of the carpet roll. Upper plate 72 overlaps box tubes 20 and 22 as shown in FIGS. 1 and 3. A cable feed bracket 80 is connected to upper plate 72 at the forward end 82 thereof. The cable feed bracket 80 is generally U-shaped open toward the forward end 82 of the upper plate 72. The cable feed bracket 80 includes a bottom wall 84, a back wall 86 and a top wall 87. Back wall 86 includes a slot 88 formed by a pair of horizontally positioned rollers 89 held in position by bolts 90. A pair of rollers 92 extends vertically between the bottom wall 84 and top wall 88. The rollers 92 are held by bolts 94 extending from the top wall 88 down through holes 95 in the top wall 88 through the center opening 96 of rollers 92 and through holes 98 of bottom wall 84.

Figure 4:
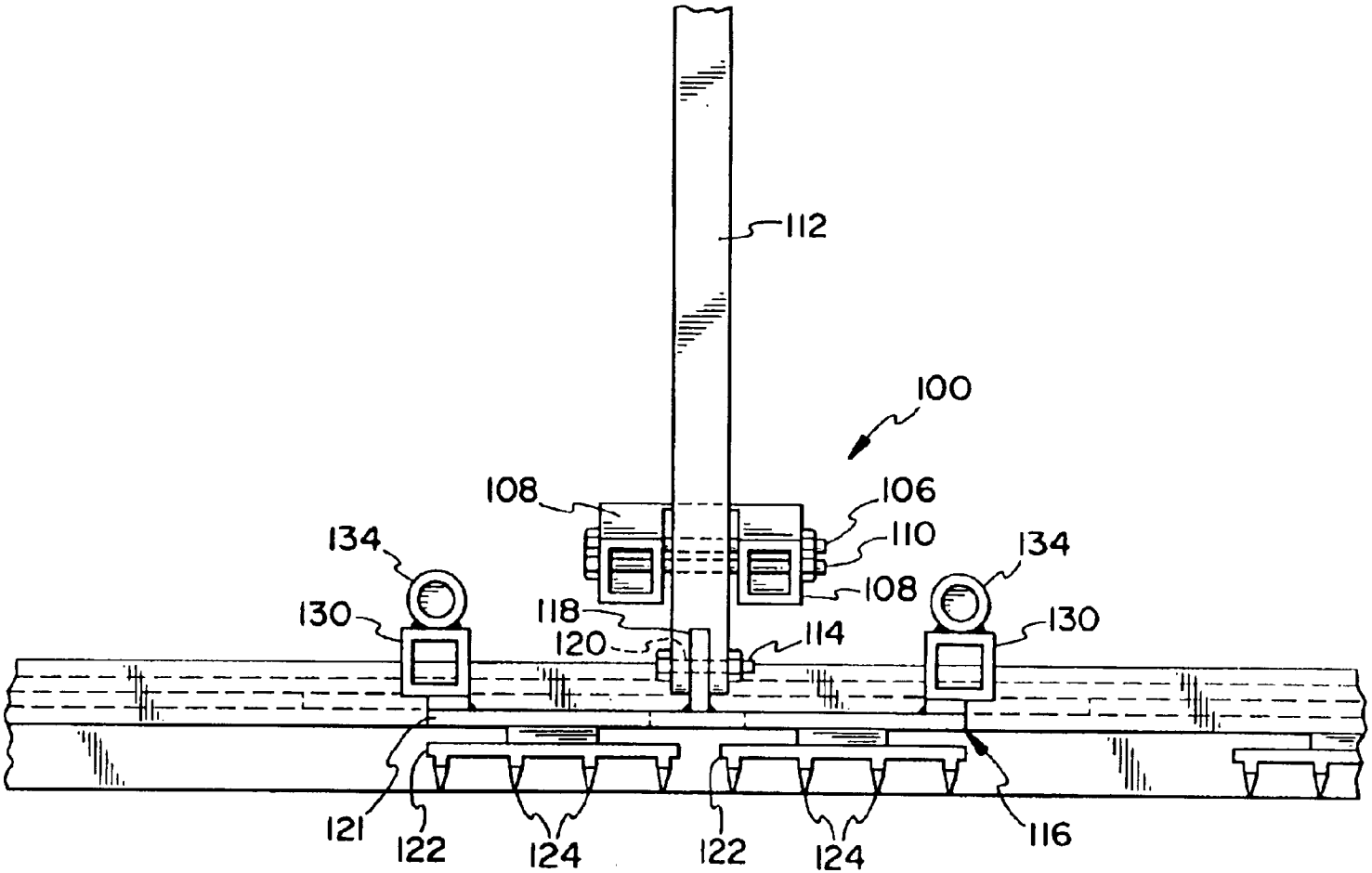
FIG. 4 is front view of the carpet adjustment tool mounted on the base member with portions of the base member broken away.
Figure 5:
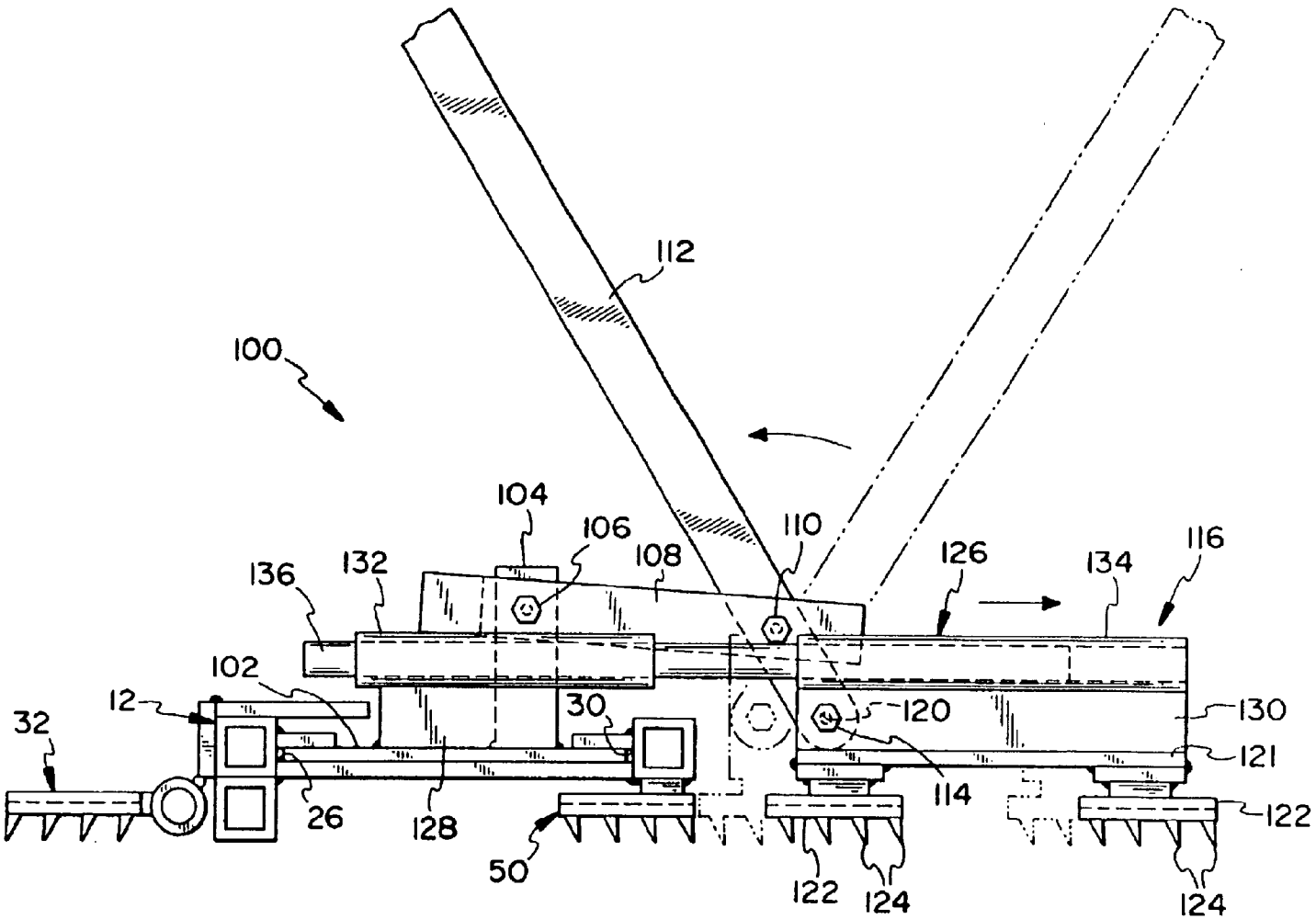
FIG. 5 is a side view of the carpet adjustment tool in the extended position having the retracted position shown in phantom.

In order to straighten bows and skews in carpet, it is necessary to stretch small portions. Now, with reference to FIGS. 1, 4 and 5 the carpet installation device 10 includes a linkage operated stretcher 100 mounted to the base member 12. The stretcher 100 has a base plate 102 sized to extend between grooves 26 and 30. The base plate is inserted into grooves 26 and 30 at one end of base member 12 and can be slid along base member 12. Base plate 102 has a post 104 preferably about three inches in length extending vertically upward. Post 104 is fixedly attached to base plate 102 preferably by welding. Post 104 includes a pin 106 extending therethrough near its upper end. Pivotally attached to the pin 106 are a pair of linkage bars 108. Linkage bars 108 are about seven inches in length and are pivotally connected via a pin 110 to a handle 112. The distance between pin 106 and pin 110 is about five inches. Handle 112 is preferably about two feet in length, but could be of variable length using telescoping sections (not shown) to achieve greater mechanical advantage. Handle 112 further includes a second pin 114 extending therethrough and spaced downwardly from pin 110 about two inches. Pin 114 pivotally connects handle 112 to a carpet gripper 116 having a bracket 118 having a hole 120 to retain the pin 114. Carpet gripper 116 includes a base plate member 121 having preferably four subplates 122. Each subplate 122 includes a group of angled spikes 124 extending in a direction away from said base member 12. A pair of telescoping braces 126 extends from supports 128 on the base plate 102 to supports 130 on base plate member 121. Each of the telescoping braces 126 includes receiving tube 132 on each of the base plate supports 128 and a receiving tube 134 on each of the supports 130 on base plate member 121. A pair of slidable rods 136 extends into and between the receiving tubes 132 and 134. Small sections of carpet can be adjusted by pulling the handle 112 rearwardly when carpet grippers 116 are engaged with the carpet to push the gripped portion of the carpet away from the carpet portion engaged by gripping attachments 50. Braces 126 act maintain the downward force on grippers 116 which tends to lift upward as handle 112 is pulled rearwardly.

Figure 6:
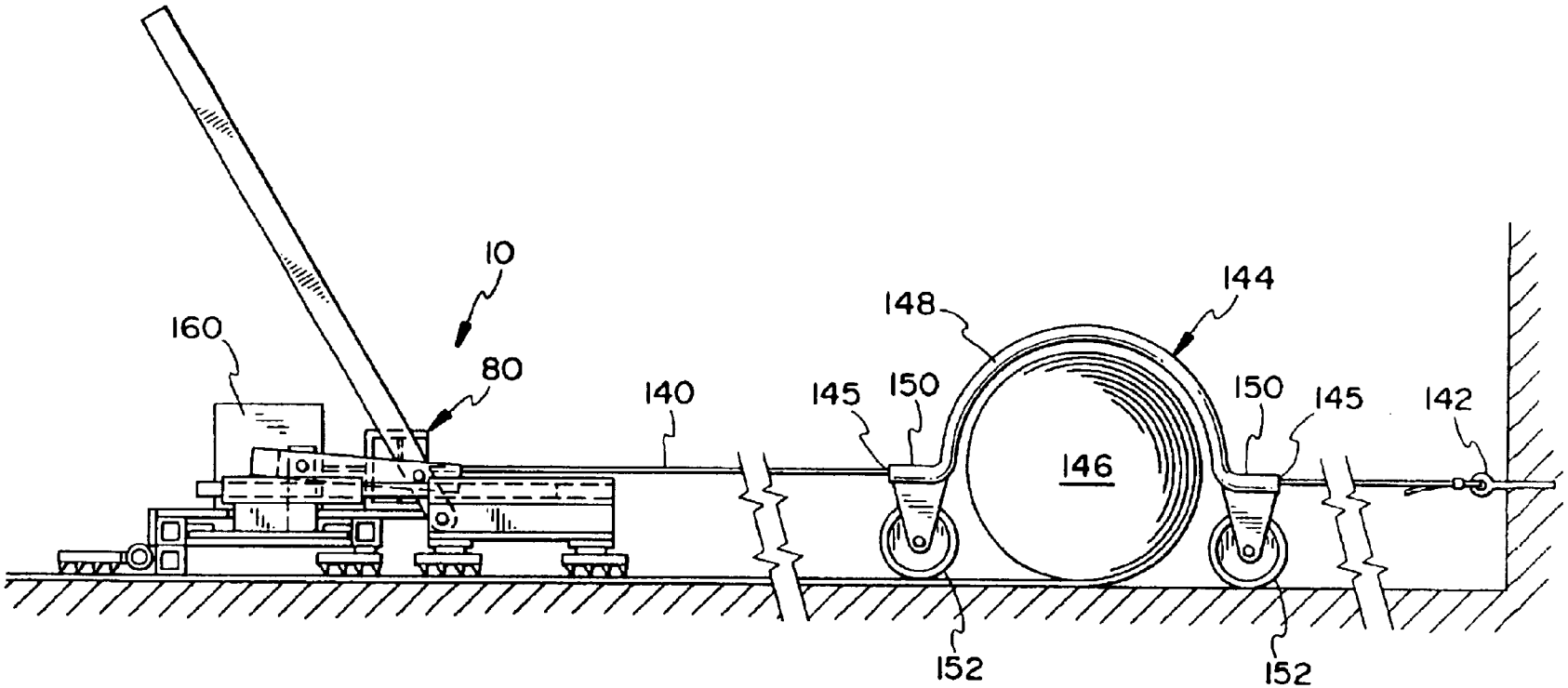
FIG. 6 is a side view of the winch cable supporting channel.
Figure 7:
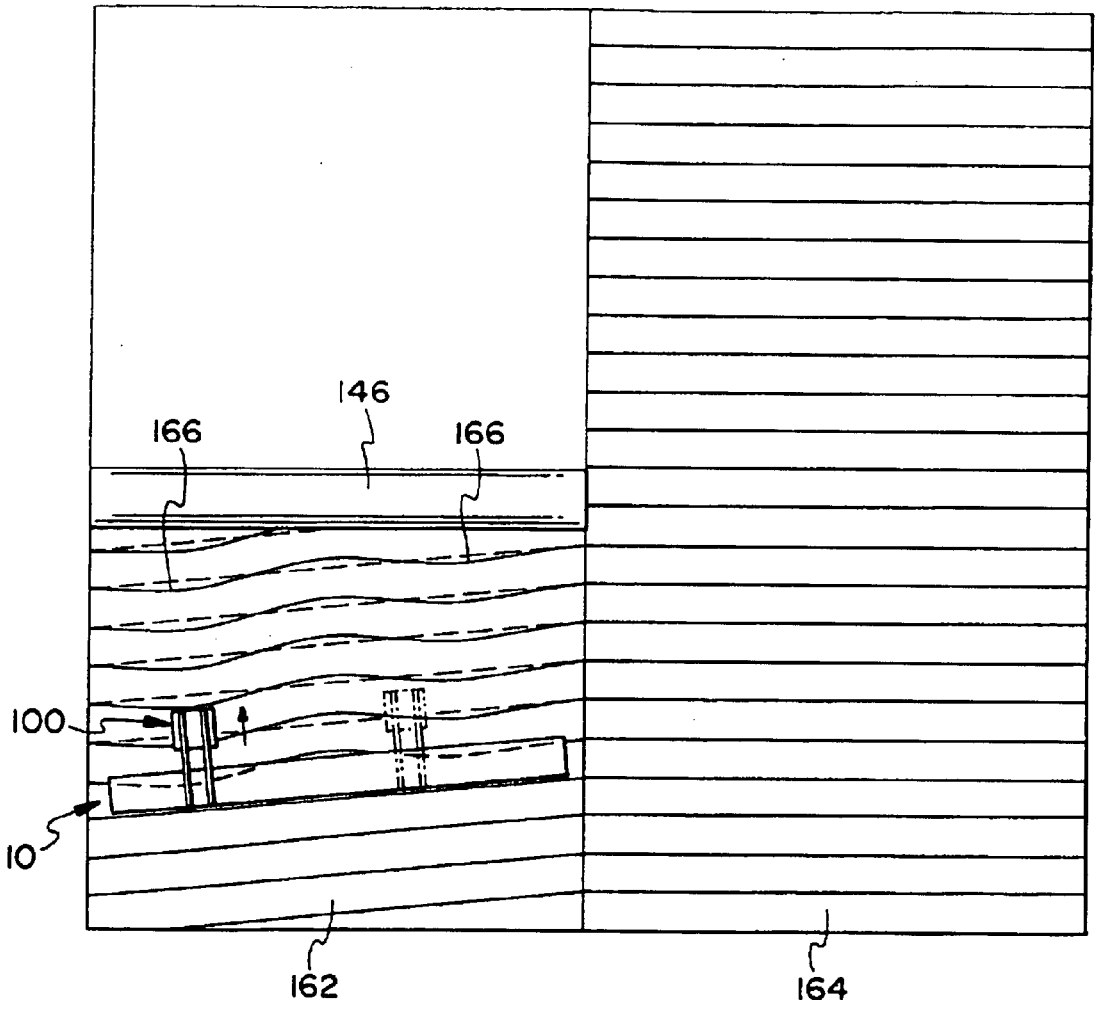
FIGS. 7 and 8 are top views of carpet installation device in operation.
Figure 8:
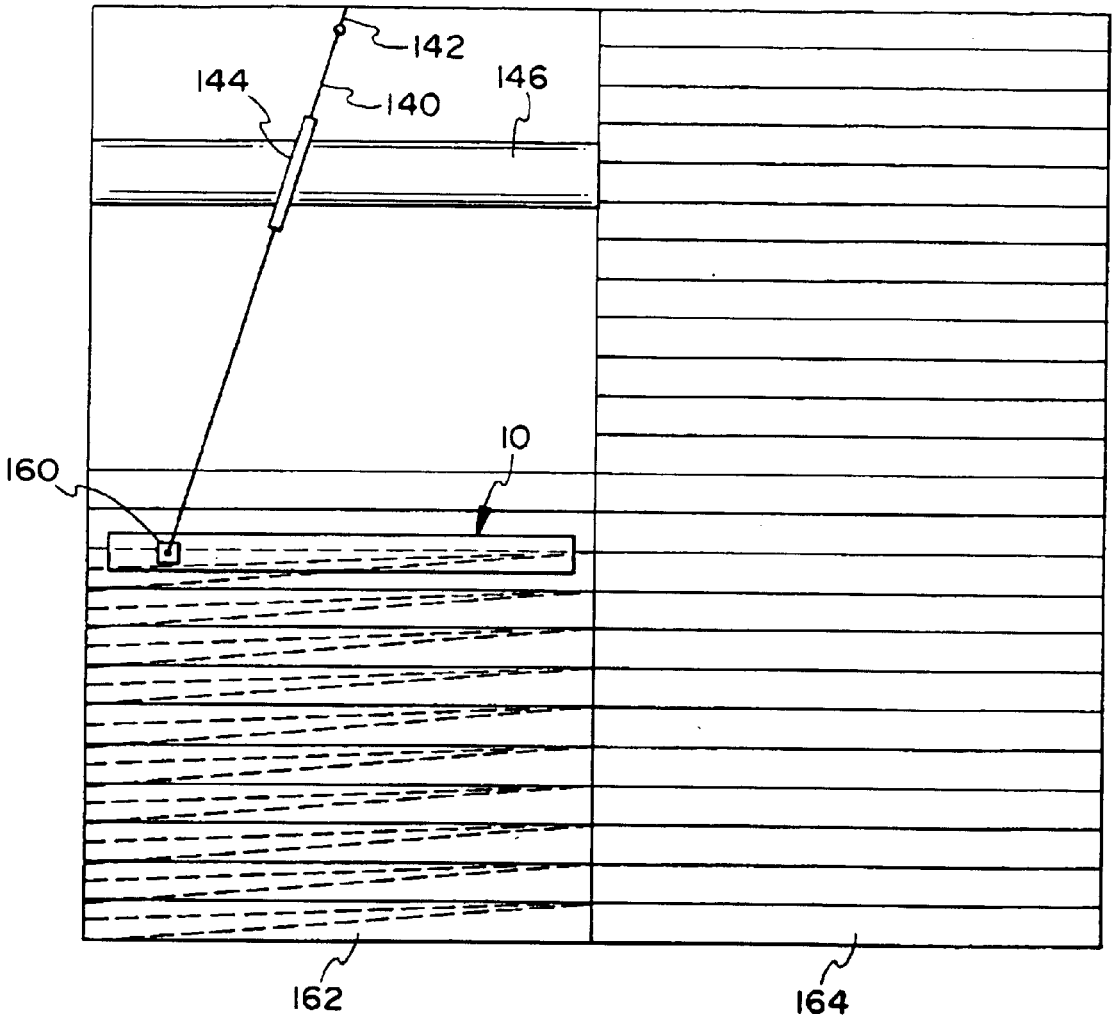

Now the operation of the installation device 10 will be further explained with reference to FIGS. 6 and 7. As shown in FIG. 6, a cable, strap, rope or chain or the like 140 extends from an anchor 142 through a cable supporting channel 144 formed of preferably a two inch diameter bent tube or pipe having an opening 145 therein to allow cable 140 to pass therethrough. Channel 144 may vary in size, but should be large enough to arch over a roll of carpet 146 forming generally a semi-circle 148 having horizontal extensions 150 thereon to redirect the cable 140. Extensions 150 will preferably include wheels 152 mounted thereon for ease of movement of the channel 144. Cable 140 extends through the channel 144 and through the cable feed bracket 80 to a winch 160 preferably bolted to the winch mounting bracket 70 as previously described. Use of the cable supporting channel 144 prevents damage to the carpet roll 146 and also prevents the cable from lifting the base member 12 when power is applied to the cable 140. As shown in FIG. 7, the installation device 10 can be used to adjust carpet 162 to match the pattern of the adjoining roll 164. As seen in FIG. 7, the carpet 162 is adjusted to straighten the bowed sections 166. Then as shown in FIG. 8 by engaging the winch 160, the base member 12 having gripping attachments 50 pull the carpet 162 into alignment with carpet 164. As previously noted, the winch mounting bracket 70 may be slid along base member 12 to provide differing angles of stretching force to adjust carpet 162.

While this invention has been described as having a preferred design, it is understood that it is capable of further modifications, uses and/or adaptations of the invention following in general the principle of the invention and including such departures from the present disclosure as come within the known or customary practice in the art to which the present invention pertains and as maybe applied to the central features hereinbefore set forth, and fall within the scope of the invention and the limits of the appended claims.

I claim:

1. A carpet installation device comprising;

a) an elongated base member forming a support for a carpet adjusting tool;

b) said base member further including a first set of carpet gripping members extending downwardly therefrom for engaging a carpet;

b) said carpet adjusting tool including a support bracket for supporting a cable-retrieving winch thereon said support bracket forming a sliding track for facilitating sliding movement of said winch along said base member;

c) said winch having a cable extending therefrom to an anchor, whereby said winch operates to tighten said cable to pull said base member toward said anchor and thereby stretching a carpet engaged to said first set of carpet gripping members of said base member.

2. The carpet installation device as set forth in claim 1 wherein:

a) said first set of carpet gripping members having carpet gripping spikes extending angularly downwardly from said base member and toward said anchor.

3. The carpet installation device as set forth in claim 1 wherein:

a) a channel is located along said cable between said base member and said anchor for positioning said cable over a roll of carpet, said channel having an arched configuration.

4. The carpet installation device as set forth in claim 3 wherein:

a) said channel includes a first end and a second end; and b) each of said first and second ends include a horizontal extension thereon.

5. The carpet installation device as set forth in claim 4 wherein:

a) each of said horizontal extensions includes a wheel thereon extending downwardly for facilitating movement of said channel.

6. The carpet installation device as set forth in claim 1 wherein:

a) said base member includes a second set of carpet gripping members having carpet gripping spikes extending angularly downwardly in a direction away from said anchor.

7. The carpet installation device as set forth in claim 6 wherein:

a) said second set of carpet gripping members are pivotally mounted to said base member so that said second set of carpet gripping members can be raised to allow sliding of said base member in a direction away from said anchor.

8. The carpet installation device as set forth in claim 1 wherein:

a) said base member having a carpet adjusting tool having a third set of carpet gripping members associated therewith.

9. The carpet installation device as set forth in claim 8 wherein:

a) said carpet adjusting tool being moveable to extend said third set of carpet gripping members away from said base member to stretch a portion of a carpet between said second set of carpet gripping members and said third set of carpet gripping members.

10. A method of installing carpet using a carpet a carpet installation device comprising the steps of:

a) setting a base member having first and second sets of carpet gripping members onto a carpet undergoing installation;

b) placing a winch mounting bracket onto said base member;

c) slidably mounting a winch on said winch mounting bracket;

d) mounting an anchor at a location spaced from said base member;

e) extending a cable from said winch to said anchor; and, d) applying tension to said cable using said winch to stretch the carpet in the direction of the anchor.

11. The carpet installation device as set forth in claim 10, further comprising the step of;

a) installing a channel between said base member and said anchor to guide said cable over a roll of carpet.

12. The carpet installation device as set forth in claim 11, further comprising the step of;

a) installing a carpet adjusting tool on said base member wherein said carpet adjusting tool has a moveable portion and a third set of carpet gripping members with said third set of carpet gripping members having carpet engaging spikes extending downwardly and angled away from said base member for stretching a portion of the carpet.

13. The carpet installation device as set forth in claim 11, wherein the step of installing a carpet adjusting tool includes;

a) slidably mounting said carpet adjusting tool on said base member.

14. The carpet installation device as set forth in claim 10, further comprising the step of;

a) forming said base member from multiple sections so that said base member is of variable length.

* * * * *